US012543838B2

(12) United States Patent
Qi et al.

(10) Patent No.: US 12,543,838 B2
(45) Date of Patent: Feb. 10, 2026

(54) NAIL LAMP, AND STORAGE METHOD FOR NAIL LAMP

(71) Applicant: Zhuhai Comax Technology Development Co., Ltd., Zhuhai (CN)

(72) Inventors: Xilin Qi, Zhuhai (CN); Debin Zhang, Zhuhai (CN)

(73) Assignee: Zhuhai Comax Technology Development Co., Ltd., Zhuhai (CN)

( * ) Notice: Subject to any disclaimer, the term of this patent is extended or adjusted under 35 U.S.C. 154(b) by 361 days.

(21) Appl. No.: 18/505,731

(22) Filed: Nov. 9, 2023

(65) Prior Publication Data

US 2024/0341443 A1 Oct. 17, 2024

(30) Foreign Application Priority Data

Apr. 12, 2023 (CN) ..... 202310394003.7

(51) Int. Cl.
*A45D 29/00* (2006.01)

(52) U.S. Cl.
CPC ..... *A45D 29/00* (2013.01); *A45D 2200/205* (2013.01)

(58) Field of Classification Search
CPC .. A45D 29/00; A45D 2200/205; B65D 25/00; B65D 85/68; B05D 3/0254
See application file for complete search history.

(56) References Cited

U.S. PATENT DOCUMENTS

| | | | | |
|---|---|---|---|---|
| 12,429,196 | B2 * | 9/2025 | Dahan | F21V 21/08 |
| 2007/0075095 | A1 * | 4/2007 | Sherman | B65D 81/36 222/215 |
| 2014/0231677 | A1 * | 8/2014 | Cheng | A45D 29/00 250/492.1 |
| 2015/0290675 | A1 * | 10/2015 | Lin | F21S 6/003 250/493.1 |
| 2015/0351516 | A1 * | 12/2015 | Doff | A45D 29/20 132/200 |
| 2016/0271646 | A1 * | 9/2016 | deGrood | A45D 27/00 |
| 2016/0368668 | A1 * | 12/2016 | King | B65D 81/3288 |
| 2017/0354235 | A1 * | 12/2017 | Miller | A45D 34/045 |
| 2018/0263356 | A1 * | 9/2018 | Cao | H04N 1/3872 |
| 2019/0150585 | A1 * | 5/2019 | Ayukawa | B29C 35/0805 |
| 2019/0281946 | A1 * | 9/2019 | Kim | A45D 29/18 |
| 2021/0120935 | A1 * | 4/2021 | Shashou | H04N 1/409 |
| 2021/0346537 | A1 * | 11/2021 | Song | A61L 2/10 |

(Continued)

FOREIGN PATENT DOCUMENTS

| | | | | |
|---|---|---|---|---|
| CH | 719899 A2 * | 1/2024 | | A45D 29/22 |
| CN | 220675386 U * | 3/2024 | | |

(Continued)

*Primary Examiner* — David A Vanore
(74) *Attorney, Agent, or Firm* — Leason Ellis LLP

(57) ABSTRACT

A nail lamp includes a base, a flexible tube and an ultraviolet lamp body. One end of the flexible tube is provided on the base, and the other end is provided with a first magnetically-attracting fit portion. The ultraviolet lamp body is provided with a plug hole and a second magnetically-attracting fit portion, the second magnetically-attracting fit portion is located at the plug hole, the other end of the flexible tube is plugged into the plug hole, and the first magnetically-attracting fit portion and the second magnetically-attracting fit portion are fitted in a magnetic attraction manner.

9 Claims, 7 Drawing Sheets

(56) References Cited

U.S. PATENT DOCUMENTS

| | | | | |
|---|---|---|---|---|
| 2022/0000241 | A1* | 1/2022 | Wang | G01P 5/12 |
| 2022/0023456 | A1* | 1/2022 | Wojczak | A61L 2/10 |
| 2022/0088238 | A1* | 3/2022 | Wade | A61L 2/10 |
| 2023/0024415 | A1* | 1/2023 | Haile | A45D 29/18 |

FOREIGN PATENT DOCUMENTS

| | | | | | |
|---|---|---|---|---|---|
| DE | 202005018552 | U1 | * | 2/2006 | A45D 29/00 |
| EP | 1707071 | A1 | * | 10/2006 | A45D 29/00 |
| EP | 4438943 | A1 | * | 10/2024 | F21V 23/0485 |
| FR | 3009374 | A1 | * | 2/2015 | A45D 29/00 |
| KR | 20150110545 | A | * | 10/2015 | B29C 49/04 |
| KR | 101708434 | B1 | * | 2/2017 | A61L 2/26 |
| KR | 20170011761 | A | * | 2/2017 | B65D 51/24 |
| KR | 20180115522 | A | * | 10/2018 | A45D 29/20 |
| WO | WO-2005020744 | A1 | * | 3/2005 | A45D 29/00 |
| WO | WO-2017191769 | A1 | * | 11/2017 | B29C 35/0805 |
| WO | WO-2025074122 | A1 | * | 4/2025 | A45D 1/28 |

* cited by examiner

NAIL LAMP, AND STORAGE METHOD FOR NAIL LAMP

CROSS-REFERENCE TO RELATED APPLICATION

This application is based on and claims the benefit of priority from Chinese Patent Application No. 2023103940037, filed on 12 Apr. 2023, the entirety of which is incorporated by reference herein.

TECHNICAL FIELD

The present disclosure relates to the field of nail lamps, and in particular to a nail lamp and a storage method for the nail lamp.

BACKGROUND

A nail lamp is capable of emitting ultraviolet light to cure the resin applied to a nail, so as to fix an ornament. A conventional nail lamp includes a base, a flexible tube and an ultraviolet lamp body, and two ends of the flexible tube are respectively connected to the base and the ultraviolet lamp body. An irradiation position of the ultraviolet lamp body can be adjusted within a certain range by bending the flexible tube. However, when such a nail lamp irradiates some positions, it is not possible to adjust the irradiation by bending the flexible tube. It is necessary to manually lift the nail lamp by holding the base, so as to adjust the irradiation position which can be laborious and somewhat cumbersome.

SUMMARY

The present disclosure aims to solve at least one of the technical problems in the existing technology. In view of this, the present disclosure provides a nail lamp, which is convenient to adjust in irradiation position and is simple and convenient to use.

The present disclosure further provides a storage method suitable for the nail lamp.

According to an embodiment in a first aspect of the present disclosure, the nail lamp includes a base, a flexible tube and an ultraviolet lamp body. One end of the flexible tube is provided on the base, and the other end is provided with a first magnetically-attracting fit portion. The ultraviolet lamp body is provided with a plug hole and a second magnetically-attracting fit portion, the second magnetically-attracting fit portion is located at the plug hole, the other end of the flexible tube is plugged into the plug hole, and the first magnetically-attracting fit portion and the second magnetically-attracting fit portion are fitted in a magnetic attraction manner.

According to the embodiment in the first aspect of the present disclosure, the nail lamp has at least the following beneficial effects. During normal use, an irradiation position of the ultraviolet lamp body can be adjusted within a certain range by bending the flexible tube. When the irradiation is needed at a special angle, the ultraviolet lamp body may be detached from the flexible tube for handheld use. The ultraviolet lamp body and the flexible tube are detachably connected by means of magnetic attraction fit and plug connection fit, and the detachable connection is firm. The magnetic attraction fit and plug connection fit can be achieved by plugging the other end of the flexible tube into the plug hole, so that the nail lamp is simple and convenient to use.

According to some embodiments of the present disclosure, a wall of the plug hole is provided with an elastic ring, and the elastic ring abuts against an outer periphery of the flexible tube.

According to some embodiments of the present disclosure, the ultraviolet lamp body includes a housing, a mounting seat and a light-emitting assembly; the housing is provided with a mounting hole, the light-emitting assembly is provided on the mounting seat, and the mounting seat is received in the mounting hole; the housing is provided with a limiting rib extending in an axis direction of the mounting hole, the limiting rib is located on a wall of the mounting hole, the mounting seat is provided with a limiting groove in the axis direction of the mounting hole, and the limiting rib is received in the limiting groove.

According to some embodiments of the present disclosure, the ultraviolet lamp body further includes a storage battery and a USB connector, the storage battery is provided on the mounting seat, the USB connector is provided on the mounting seat, and the USB connector is electrically connected to the storage battery.

According to some embodiments of the present disclosure, an end of the ultraviolet lamp body in a length direction is a light emergence end, and an outer periphery of the ultraviolet lamp body is in a shape of a truncated cone, and the light emergence end of the ultraviolet lamp body has a diameter greater than a diameter of the other end of the ultraviolet lamp body.

According to some embodiments of the present disclosure, the one end of the flexible tube is connected to the outer periphery of the ultraviolet lamp body.

According to some embodiments of the present disclosure, the one end of the flexible tube is detachably connected to the base, the base is provided with a first storage structure and a second storage structure, the ultraviolet lamp body is capable of being mounted in the first storage structure or detached from the first storage structure, and the flexible tube is capable of being folded and mounted in the second storage structure or detached from the second storage structure.

According to some embodiments of the present disclosure, the first storage structure is a pair of first elastic clips, the paired first elastic clips are spaced apart and configured to clamp the ultraviolet lamp body.

According to some embodiments of the present disclosure, the first elastic clip includes a first connecting block and two first elastic arms, one end of each of the first elastic arms is connected to the first connecting block, the first connecting block is connected to the base, the two first elastic arms are spaced apart and enclosed to form the first clamping groove, the other ends of the two first elastic arms form an opening of the first clamping groove, and the first connecting block and the first elastic arms are of an integrated injection molded structure.

According to the second aspect of the present disclosure, the storage method of the nail lamp includes the following steps: detaching the ultraviolet lamp body from the flexible tube; detaching the flexible tube from the base; mounting the ultraviolet lamp body on the first storage structure of the base; folding and mounting the flexible tube on the second storage structure of the base.

According to the second aspect of the present disclosure, the storage method for the nail lamp has at least the following beneficial effects. With the above-mentioned storage method for the nail lamp, a transportation space is saved, and the risk of damaging the nail lamp during transportation is reduced.

Additional aspects and advantages of the present disclosure will be set forth in part in the following description, which will be in part apparent from the following description, or may be learned by practice of the present disclosure.

BRIEF DESCRIPTION OF DRAWINGS

The foregoing and/or additional aspects and advantages of the present disclosure will be apparent and readily understood from the description of embodiments in conjunction with the following accompanying drawings, in which.

LIST OF REFERENCE NUMERALS

Figure 1:
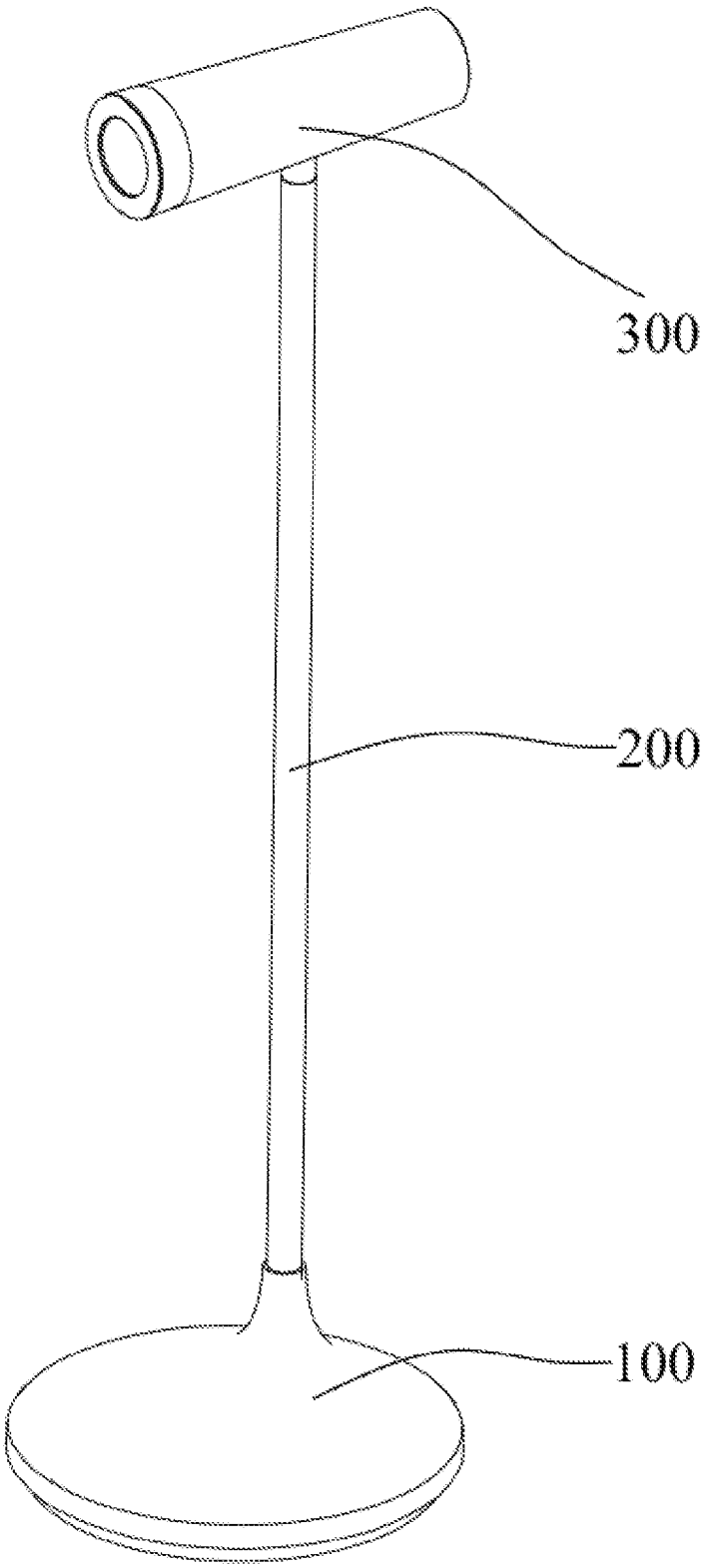
FIG. 1 is a schematic perspective view of a nail lamp according to an embodiment of the present disclosure.

100 Base, 110 First elastic clip, 111 First connecting block, 112 First elastic arm, 120 First receiving groove, 130 Second elastic clip, 131 Second connecting block, 132 Second elastic arm, 133 Arc-shaped groove, 140 Second receiving groove;

200 Flexible tube, 210 First magnetically-attracting fit portion;

300 Ultraviolet lamp body, 301 Plug hole, 310 Second magnetically-attracting fit portion, 320 Elastic ring, 330 Housing, 331 Mounting hole, 332 Limiting rib, 340 Mounting seat, 341 Limiting groove, 350 Light-emitting assembly, 360 Storage battery, 370 USB connector, 380 Reflector, 390 Protective glass, 391 Ring-shaped cover.

DETAILED DESCRIPTION

Embodiments of the present disclosure will be described in detail below, and examples of the embodiments are shown in the accompanying drawings, wherein the same or similar reference numerals represent the same or similar elements or elements having the same or similar functions throughout. The embodiments described below with reference to accompanying drawings are exemplary and are merely intended to be illustrative of the present disclosure, and will not be interpreted as limiting the present disclosure.

In the description of the present disclosure, it should be understood that the orientations or the position relationships indicated by the terms such as "upper" and "lower" are based on the orientations or the position relationships shown in the accompanying drawings, which are only for ease of description of the present disclosure and for simplifying the description, rather than indicating or implying that the devices or elements referred to necessarily have a specific orientation, or are constructed and operated in a specific orientation, and therefore cannot be construed as limiting the present disclosure.

In the description of the present application, the term "a plurality of" means two or more. The terms "first" and "second" if described are intended to distinguish the technical features only and should not be construed as indicating or implying relative importance, or implicitly indicating the number of technical features indicated, or implicitly indicating the sequence of the technical features indicated.

In the description of the present disclosure, unless otherwise clearly defined, words such as provision, mounting, and connection should be construed in a broad sense, and those of ordinary skills in the art wound have been able to reasonably determine the specific meanings of the above words in the description of the present disclosure in combination with the specific content of the technical solution.

Figure 2:
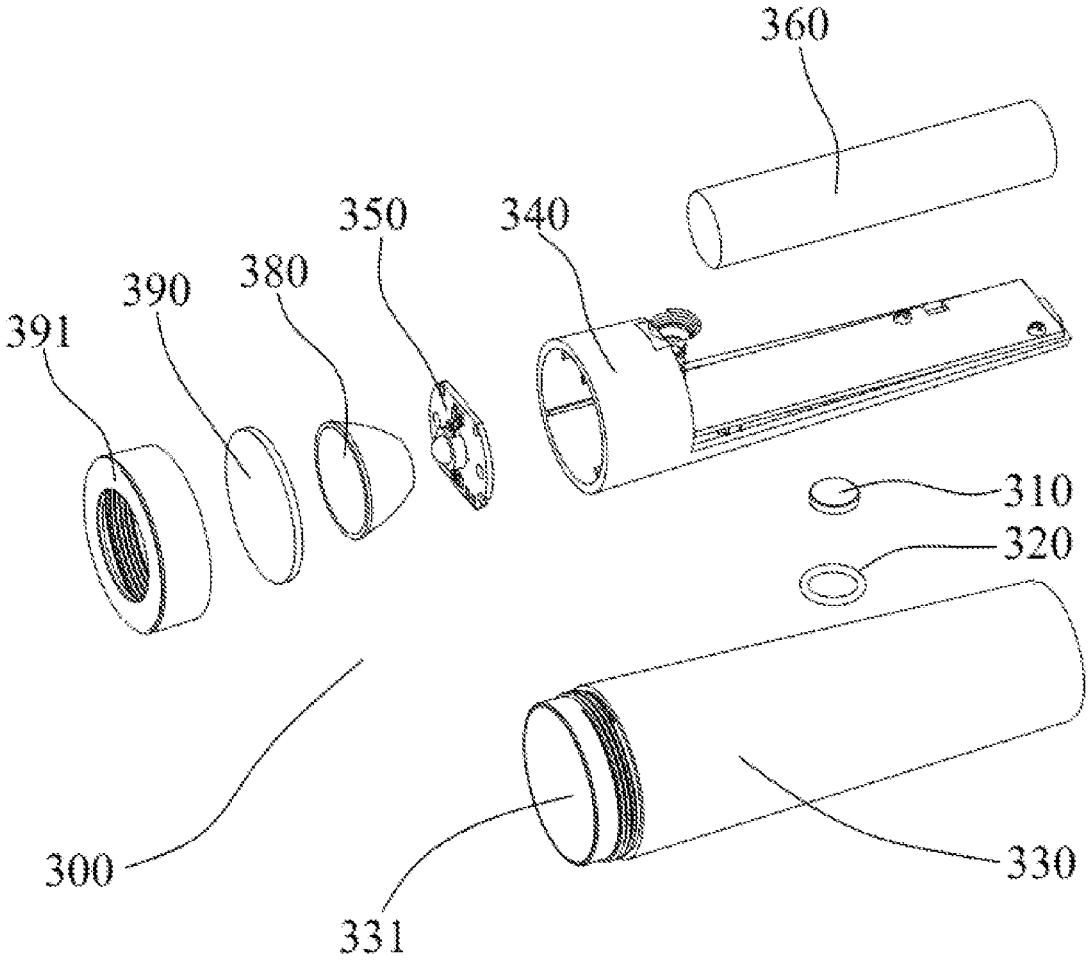
FIG. 2 is a schematic exploded view of an ultraviolet lamp body according to an embodiment of the present disclosure.
Figure 3:
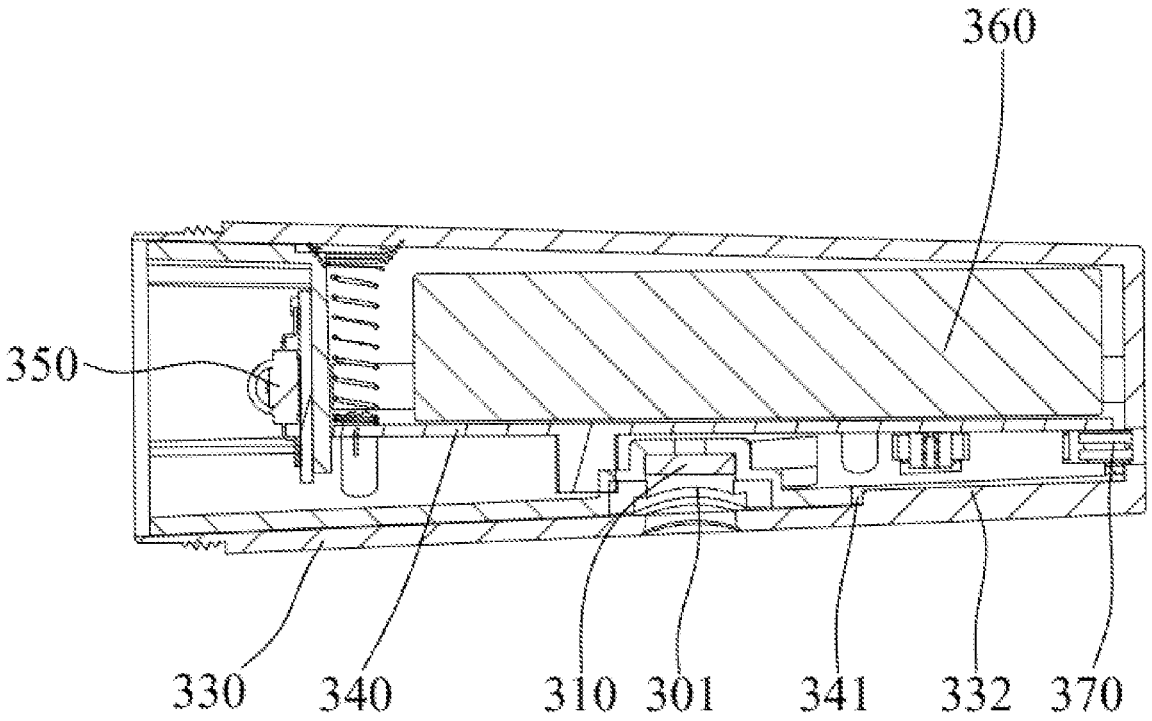
FIG. 3 is a schematic cross-sectional view of a partial structure of the ultraviolet lamp body according to an embodiment of the present disclosure.
Figure 4:
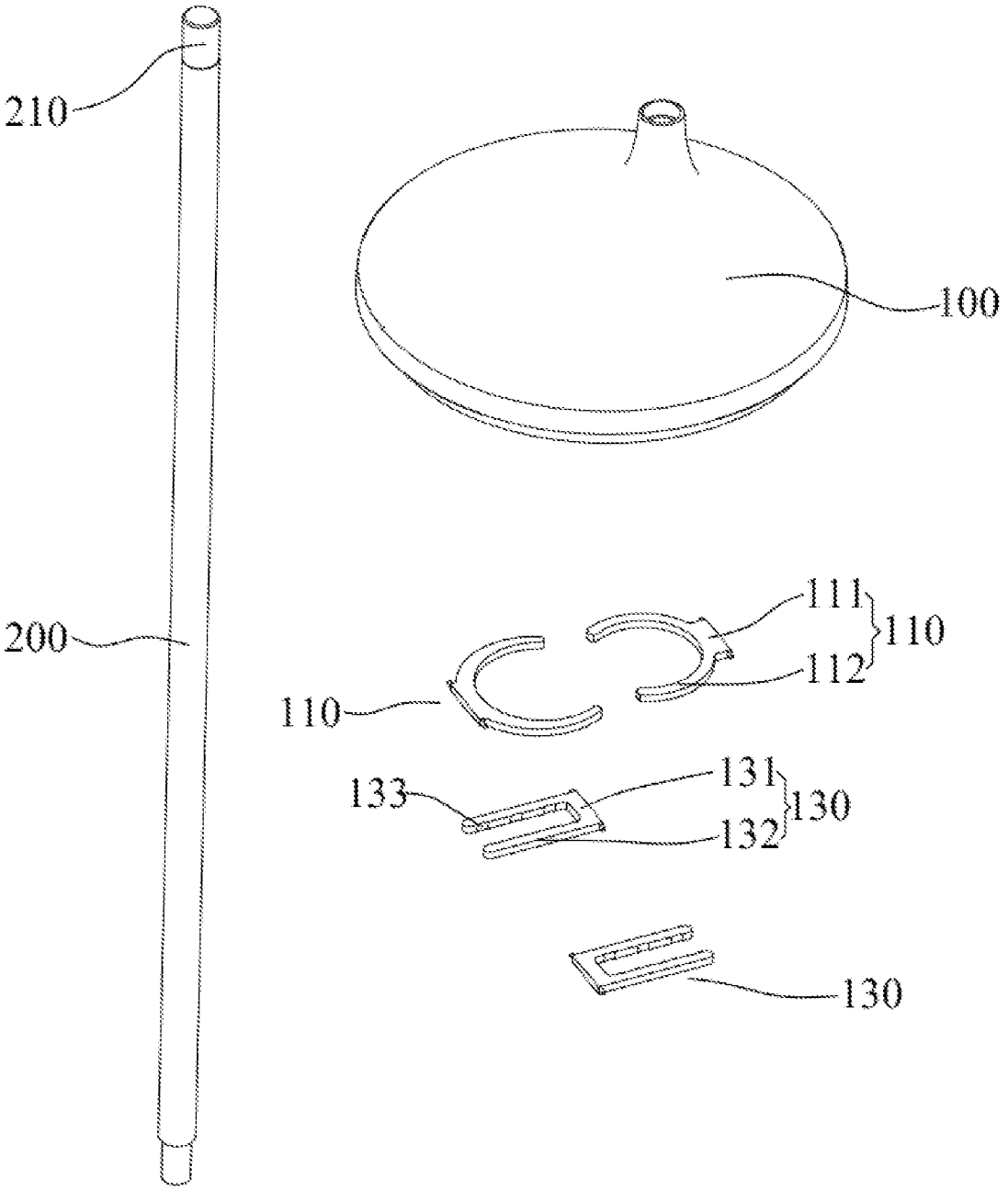
FIG. 4 is a schematic exploded view of a flexible tube and a base according to an embodiment of the present disclosure.
Figure 5:
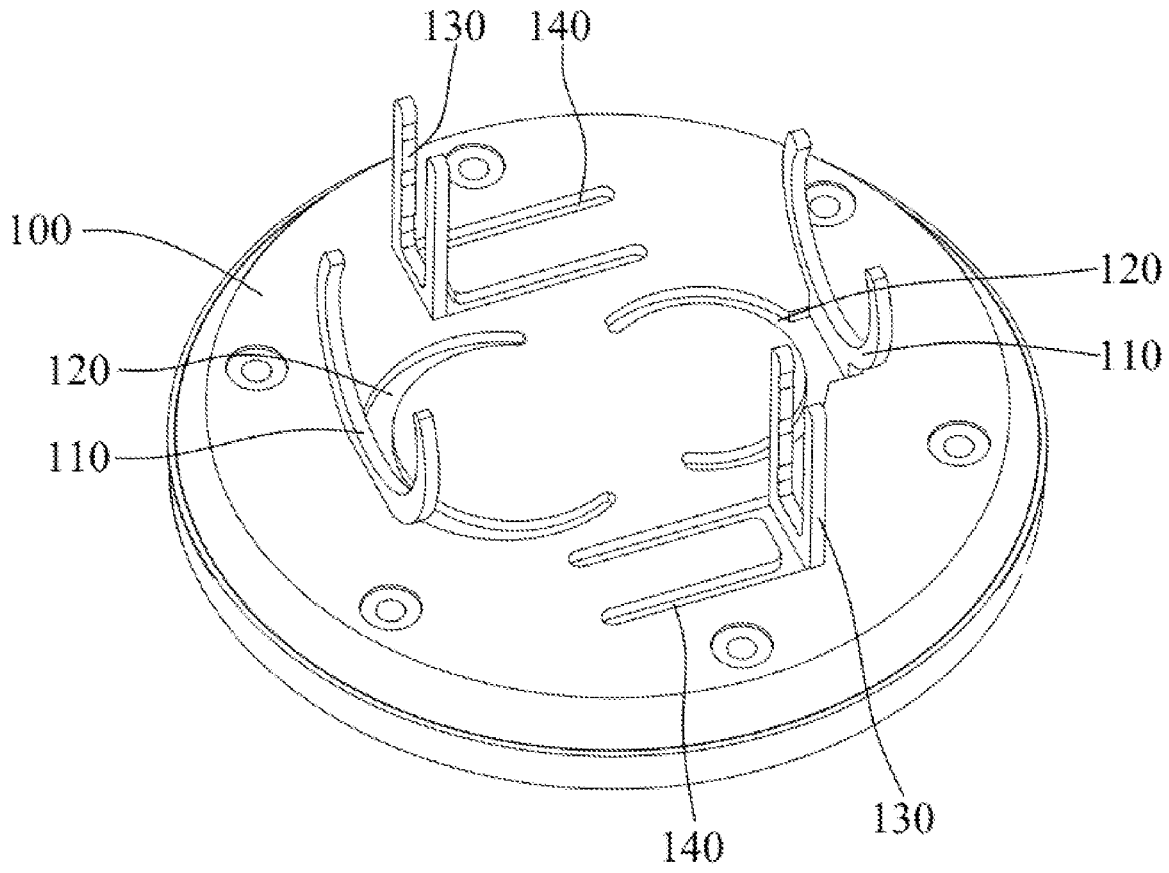
FIG. 5 is a schematic perspective view of the base according to an embodiment of the present disclosure, in which first elastic clips extend out of the first receiving grooves, and the second elastic clips extend out of the second receiving grooves.
Figure 6:
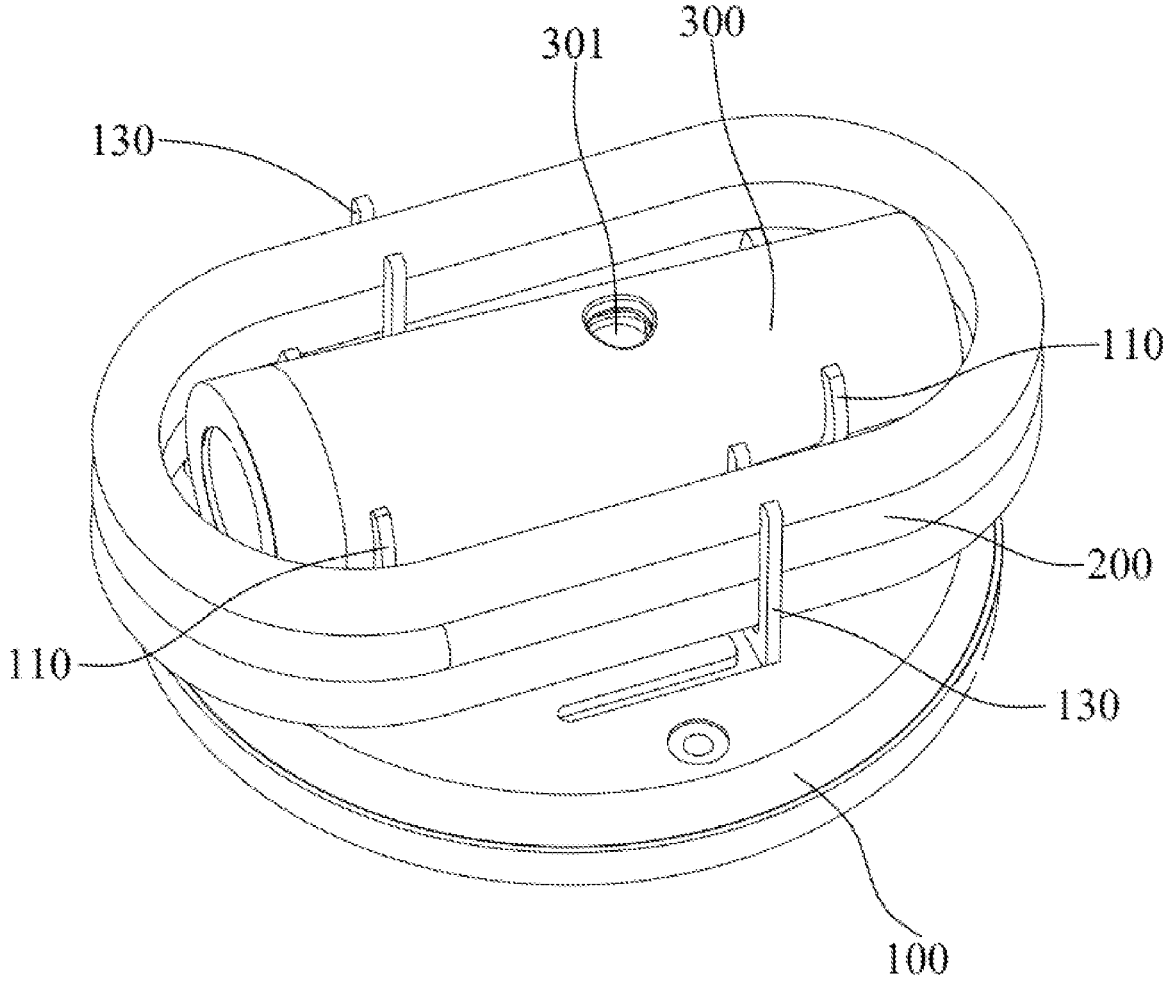
FIG. 6 is a schematic perspective view of the flexible tube and the ultraviolet lamp body according to an embodiment of the present disclosure during storage.
Figure 7:
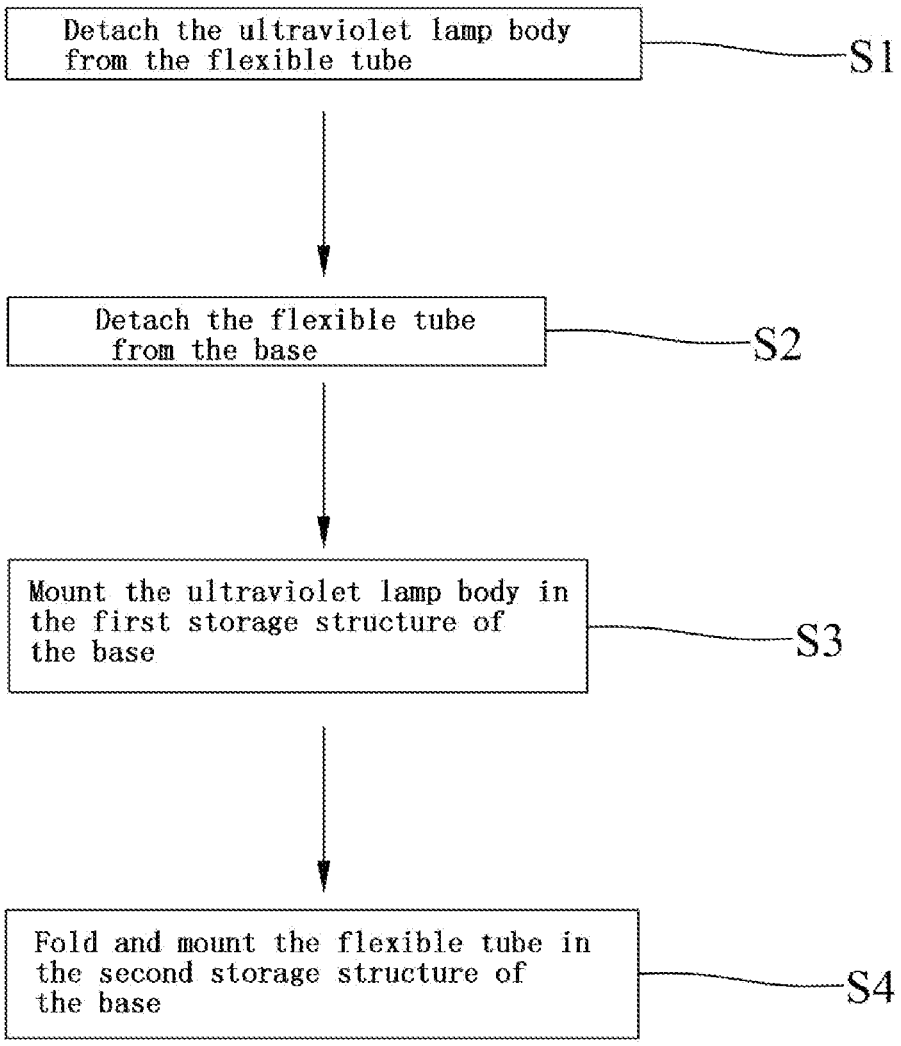
FIG. 7 is a flow chart of a storage method for the nail lamp according to an embodiment of the present disclosure.

Referring to FIGS. 1 to 7, a nail lamp according to an embodiment of the present disclosure includes a base 100, a flexible tube 200 and an ultraviolet lamp body 300. One end of the flexible tube 200 is provided on the base 100, and the other end is provided with a first magnetically-attracting fit portion 210. The ultraviolet lamp body 300 is provided with a plug hole 301 and a second magnetically-attracting fit portion 310, the second magnetically-attracting fit portion 310 is located at the plug hole 301, the other end of the flexible tube 200 is plugged into the plug hole 301, and the first magnetically-attracting fit portion 210 and the second magnetically-attracting fit portion 310 are fitted in a magnetic attraction manner. During normal use, an irradiation position of the ultraviolet lamp body 300 can be adjusted within a certain range by bending the flexible tube 200. When the irradiation is needed at a special angle, the ultraviolet lamp body 300 may be disconnected from the flexible tube 200 for handheld use. The ultraviolet lamp body 300 and the flexible tube 200 are detachably connected by means of magnetic attraction fit and plug connection fit, and the detachable connection is firm. The magnetic attraction fit and plug connection fit can be achieved by plugging the other end of the flexible tube 200 into the plug hole 301, so that the nail lamp is simple and convenient to use.

Specifically, the first magnetically-attracting fit portion 210 is an iron block, and the second magnetically-attracting fit portion 310 is a magnet. It is conceivable that the first magnetically-attracting fit portion 210 may also be a magnet, and the second magnetically-attracting fit portion 310 is an iron block. Specifically, the second magnetically-attracting fit portion 310 is provided at the bottom of the plug hole 301, having a better plugging effect. It is also conceivable that the second magnetically-attracting fit portion 310 may also be provided on a side wall of the plug hole 301.

In an embodiment, the wall of the plug hole 301 is provided with an elastic ring 320, and the elastic ring 320 abuts against an outer periphery of the flexible tube 200. By providing the elastic ring 320, the plug connection between the plug hole 301 and the flexible tube 200 is firmer. Specifically, the elastic ring 320 may be a rubber elastic ring 320 or a metal elastic ring 320, or a sealing ring may actually be used as the elastic ring 320.

In an embodiment, the ultraviolet lamp body 300 includes a housing 330, a mounting seat 340 and a light-emitting assembly 350, the housing 330 is provided with a mounting hole 331, the light-emitting assembly 350 is provided on the mounting seat 340, and the mounting seat 340 is received in the mounting hole 331. The housing 330 is provided with a limiting rib 332 extending in an axis direction of the mounting hole 331, the limiting rib 332 is located on a wall of the mounting hole 331, the mounting seat 340 is provided with a limiting groove 341 in the axis direction of the mounting hole 331, and the limiting rib 332 is received in the limiting groove 341. During production, the light-emitting assembly 350 is mounted on the mounting seat 340, and the mounting seat 340 is then mounted into the mounting hole 331 in the axis direction of the mounting hole 331. During this process, the limiting groove 341 needs to be aligned to the limiting rib 332, and the limiting rib 332 is finally inserted into the limiting groove 341, such that a mounting angle of the mounting seat 340 is accurate.

Specifically, the light-emitting assembly 350 includes a PCB and an LED lamp bead provided on the PCB. The PCB is attached to the housing 330 by locking screws.

Specifically, the mounting seat 340 is provided with a through hole, and the housing 330 is provided with a threaded hole, and a screw is passed into the through hole and then threadedly connected to the threaded hole, and the mounting seat 340 is secured to the housing 330 by locking screws.

In an embodiment, the ultraviolet lamp body 300 further includes a storage battery 360 and a USB connector 370, the storage battery 360 is provided on the mounting seat 340, and the USB connector 370 is provided on the mounting seat 340 and electrically connected to the storage battery 360. By providing the storage battery 360, normal power supply can also be convenient when the ultraviolet lamp body 300 is separately used in a handheld manner. By providing the USB connector 370, a charging operation can be conveniently performed on the storage battery 360. Specifically, the USB connector 370 is a Type-C connector.

Specifically, the ultraviolet lamp body 300 further includes a reflector 380, a piece of protective glass 390 and a ring-shaped cover 391. The reflector 380 is provided in the mounting hole 331 and located on a light-emitting side of the light-emitting assembly 350, and is configured to adjust a light emergence angle. The protective glass 390 is provided in the mounting hole 331 and shields the reflector 380 for watertightness and dust prevention, the ring-shaped cover 391 is threadedly connected to the housing 330 and clamps and fixes the protective glass 390 cooperatively with the housing 330.

In an embodiment, an end of the ultraviolet lamp body 300 in a length direction is a light emergence end, and an outer periphery of the ultraviolet lamp body 300 is in a shape of a truncated cone, and the light emergence end of the ultraviolet lamp body 300 has a diameter greater than a diameter of the other end of the ultraviolet lamp body 300. The above-mentioned structure is convenient to hold and use, so it is convenient to distinguish the light emergence end visually.

In an embodiment, one end of the flexible tube 200 is connected to the outer periphery of the ultraviolet lamp body 300. The flexible tube 200 is connected to the side wall of the ultraviolet lamp body 300. Compared with connection with two ends of the ultraviolet lamp body 300, a torque exerted on the flexible tube 200 by the ultraviolet lamp body 300 is smaller, which is conductive to keeping the flexible tube 200 in a bent shape. Specifically, the flexible tube 200 is a flexible hose, the flexible tube 200 may be made by wrapping a flexible metal strip with a braided layer or a soft rubber layer, and the flexible metal strip may be made of a steel wire, an iron wire, a copper wire, etc.

In an embodiment, one end of the flexible tube 200 is detachably connected to the base 100, the base 100 is provided with a first storage structure and a second storage structure, the ultraviolet lamp body 300 can be mounted in the first storage structure or detached from the first storage structure, and the flexible tube 200 can be folded and mounted in the second storage structure or detached from the second storage structure.

Specifically, one end of the flexible tube 200 is detachably connected to the base 100 in a plugged manner. It is conceivable that one end of the flexible tube 200 may be detachably connected to the base 100 in a threaded connection manner.

When the nail lamp is subjected to vibrations, if the ultraviolet lamp body 300 is mounted on the flexible tube 200, a larger transport box is required to fully receive the nail lamp, and the ultraviolet lamp body 300 has a certain weight, frequent vibrations may damage the flexible tube 200. Therefore, the nail lamp is typically transformed into a transport structure during transportation, that is, the ultraviolet lamp body 300, the flexible tube 200 and the base 100 are disassembled and then transported together. By providing the first storage structure and the second storage structure, the ultraviolet lamp body 300 and the flexible tube 200 are detached from the base 100 before the nail lamp is transported, the ultraviolet lamp body 300 is then mounted in the first storage structure, and the flexible tube 200 is mounted in the second storage structure. During transportation, the ultraviolet lamp body 300 and the flexible tube 200 are less possibly lost. Before use, the ultraviolet lamp body 300 is detached from the first storage structure, the flexible tube 200 is detached from the second storage structure, and the two ends of the flexible tube 200 are then connected to the ultraviolet lamp body 300 and the base 100, thereby completing the assembly.

Specifically, one end of the flexible tube 200 is detachably connected to the base 100 in a plugged manner. It is conceivable that one end of the flexible tube 200 may also be detachably connected to the base 100 in a threaded connection manner.

In an embodiment, the present disclosure further provides a storage method for the nail lamp, which is suitable for assembling the nail lamp into a structure suitable for transportation. The storage method includes the following steps:

- S1: detaching the ultraviolet lamp body 300 from the flexible tube 200;
- S2: detaching the flexible tube 200 from the base 100;
- S3: mounting the ultraviolet lamp body 300 in the first storage structure of the base 100;
- S4: folding and mounting the flexible tube 200 in the second storage structure of the base 100.

With the above storage method, the nail lamp is assembled into the structure suitable for transportation, saving a transportation space and reducing the risk of damaging the nail lamp during transportation.

In an embodiment, the first storage structure is a pair of first elastic clips 110, the paired first elastic clips 110 are spaced apart and configured to clamp the ultraviolet lamp body 300. The paired first elastic clips 110 clamp the ultraviolet lamp body 300, and the two first elastic clips 110 clamp the two ends of the ultraviolet lamp body 300, so that the ultraviolet lamp body 300 can be clamped and fixed, making the mounting relatively firm. The ultraviolet lamp body 300 can be detached only by detaching the ultraviolet lamp body 300 from the first elastic clips 110. Using the first elastic clips 110, the ultraviolet lamp body 300 is convenient to mount and detach when the nail lamp is transported.

In an embodiment, the first elastic clip 110 includes a first connecting block 111 and two first elastic arms 112, one end of each of the first elastic arms 112 is connected to the first connecting block 111, the first connecting block 111 is connected to the base 100, the two first elastic arms 112 are spaced apart and enclosed to form the first clamping groove, the two first elastic arms 112 form an opening of the first clamping groove at the other end of the first elastic arms 112, and the first connecting block 111 and the first elastic arms 112 are of an integrated injection molded structure. With the above structure, the first elastic arms 112 can open the opening when deforming elastically, such that the ultraviolet lamp body 300 can be snapped into or disengaged from the first clamping groove. Specifically, the first connecting block 111 and the two first elastic arms 112 thereon are of an integral injection molded structure, and the first elastic clips 110 are made of a plastic material, such as Polycarbonate (PC), Polyvinyl chloride (PVC), Polystyrene (PS), Polymethyl Methacrylate (PMMA), etc., such that the first elastic arms 112 have elasticity. It is conceivable that the first elastic clips 110 may also be of other structures. For example, the two first elastic arms 112 are pivotally connected to the first connecting block 111, and a spring is provided between the two first elastic arms 112, such that the two first elastic arms 112 have elasticity.

In an embodiment, the base 100 is provided with first receiving grooves 120, and the first elastic clips 110 are pivotally connected to the base 100 and can be, by rotation, received into the first receiving grooves 120 or extend out of the first receiving grooves 120. When the first elastic clips 110 are not in use, the first elastic clips 110 are received into the first receiving grooves 120 by rotation, saving a use space; when the first elastic clips 110 are to be used, the first elastic clips 110 extend out by rotation. Specifically, a rotating shaft portion is provided on the first connecting block 111 of the first elastic clip 110, and the base 100 is provided with a rotating shaft hole, and the rotating shaft portion is arranged to extend through the rotating shaft hole.

It is conceivable that the first mounting structure may also be other structures. For example, the first mounting structure is a suction cup, which can suck the outer periphery of the ultraviolet lamp body 300. Alternatively, the first mounting structure is a magnetic attraction component, the outer periphery of the ultraviolet lamp body 300 is provided with an irony component, and the mounting is achieved by means of magnetic attraction fit.

In an embodiment, the second storage structure is second elastic clips 130, and the second elastic clips 130 are configured to clamp the flexible tube 200. The flexible tube 200 are fixed by the second elastic clips 130 during transportation, and the mounting and disassembly are relatively convenient.

In an embodiment, the base 100 is provided with second receiving grooves 140, and the second elastic clips 130 are pivotally connected to the base 100 and can be, by rotation, received into the second receiving grooves 140 or extend out of the second receiving grooves 140. When the second elastic clips 130 are not in use, the second elastic clips 130 are received into the second receiving grooves 140 by rotation, saving the use space; when the second elastic clips 130 need to be used, the second elastic clips 130 extend out by rotation. Specifically, the second connecting block 131 of the second elastic clip 130 is provided with a rotating shaft portion, the base 100 is provided with a rotating shaft hole, and the rotating shaft portion is arranged to extend through the rotating shaft hole.

In an embodiment, the second elastic clip 130 includes a second connecting block 131 and two second elastic arms 132, one end of each of the second elastic arms 132 is connected to the second connecting block 131, the second connecting block 131 is connected to the base 100, the two second elastic arms 132 are spaced apart and enclosed to form the second clamping groove, the two second elastic arms 132 form an opening of the second clamping groove at the other end, and the second connecting block 131 and the second elastic arms 132 are of an integrated injection molded structure. With the above structure, the second elastic arms 132 can open the opening when deforming elastically, such that the flexible tube 200 can be snapped into or disengaged from the second clamping groove. Specifically, the second connecting block 131 and the two second elastic arms 132 thereon are of the integral injection molded structure, and the second elastic clips 130 are made of a plastic material, such as PC, PVC, PS, PMMA, etc., such that the second elastic arms 132 have elasticity. It is conceivable that the second elastic clips 130 may also be of other structures. For example, the two second elastic arms 132 are pivotally connected to the second connecting block 131, and a spring is provided between the two second elastic arms 132, such that the two second elastic arms 132 have elasticity.

In an embodiment, a side wall of the second clamping groove is provided with three arc-shaped grooves 133, and adjacent two arc-shaped grooves 133 on the same side wall are arranged from the bottom of the second clamping groove to the opening of the second clamping groove. By arranging the three arc-shaped grooves 133, and the flexible tube 200 can be coiled in three turns and snapped into the second elastic clips 130. In this case, the arc-shaped grooves 133 can limit each turn of the flexible tube 200, having a good fixing effect. It is conceivable that one, two, or three or more arc-shaped grooves 133 may be provided on the side wall of the second clamping groove to clamp different lengths of flexible tubes 200 coiled into different turns.

It is conceivable that the second mounting structure may also be other structures. For example, the second mounting structure is a magnetic attraction component, and the mounting is achieved by magnetically attracting the flexible tube 200.

Specifically, both the first elastic clips 110 and the second elastic clips 130 are provided on a bottom surface of the base 100, reducing the impact on a product appearance.

In the description of the specification, the explanation with reference to the terms such as "an embodiment", "some embodiments", "exemplary embodiments", "specific examples", or "some examples" means that specific features, structures, materials, or characteristics described in combination with the embodiment(s) or example(s) are included in at least one embodiment or example of the present disclosure. In this specification, the schematic expressions of the above terms do not necessarily refer to the same embodiments or examples. Moreover, the specific features, structures, materials, or characteristics described herein may be combined in any one or more embodiments or examples in a suitable manner.

Although the embodiments of the present disclosure have been shown and described, those of ordinary skills in the art may appreciate that various changes, modifications, substitutions, and variations may be made to these embodiments without departing from the principle and gist of the present disclosure, and the scope of the present disclosure is defined by the appended claims and equivalents thereof.

What is claimed is:

1. A nail lamp, comprising:

a base;

a flexible tube with one end arranged on the base and the other end provided with a first magnetically-attracting fit portion; and an ultraviolet lamp body provided with a plug hole and a second magnetically-attracting fit portion, the second magnetically-attracting fit portion being located at the plug hole, the other end of the flexible tube being plugged into the plug hole, and the first magnetically-attracting fit portion and the second magnetically-attracting fit portion being fitted in a magnetic attraction manner.

2. The nail lamp according to claim 1, wherein a wall of the plug hole is provided with an elastic ring, and the elastic ring abuts against an outer periphery of the flexible tube.

3. The nail lamp according to claim 1, wherein the ultraviolet lamp body comprises a housing, a mounting seat and a light-emitting assembly; the housing is provided with a mounting hole, the light-emitting assembly is provided on the mounting seat, and the mounting seat is received in the mounting hole; the housing is provided with a limiting rib extending in an axis direction of the mounting hole, the limiting rib is located on a wall of the mounting hole, the mounting seat is provided with a limiting groove in the axis direction of the mounting hole, and the limiting rib is received in the limiting groove.

4. The nail lamp according to claim 3, wherein the ultraviolet lamp body further comprises a storage battery and a USB connector, the storage battery is provided on the mounting seat, and the USB connector is provided on the mounting seat and electrically connected to the storage battery.

5. The nail lamp according to claim 1, wherein an end of the ultraviolet lamp body in a length direction is a light emergence end, and an outer periphery of the ultraviolet lamp body is in a shape of a truncated cone, and the light emergence end of the ultraviolet lamp body has a diameter greater than a diameter of the other end of the ultraviolet lamp body.

6. The nail lamp according to claim 5, wherein the one end of the flexible tube is connected to the outer periphery of the ultraviolet lamp body.

7. The nail lamp according to claim 1, wherein the one end of the flexible tube is detachably connected to the base, and the base is provided with a first storage structure and a second storage structure, the ultraviolet lamp body is capable of being mounted in the first storage structure or detached from the first storage structure, and the flexible tube is capable of being folded and mounted in the second storage structure or detached from the first storage structure.

8. The nail lamp according to claim 7, wherein the first storage structure is a pair of first elastic clips, and the paired first elastic clips are spaced apart and configured to clamp the ultraviolet lamp body.

9. The nail lamp according to claim 8, wherein the first elastic clip comprises a first connecting block and two first elastic arms, one end of each of the first elastic arms is connected to the first connecting block, the first connecting block is connected to the base, the two first elastic arms are spaced apart and enclosed to form the first clamping groove, the other ends of the two first elastic arms form an opening of the first clamping groove, and the first connecting block and the first elastic arms are of an integrated injection molded structure.

* * * * *